US010131462B2

(12) United States Patent
Capistrant et al.

(10) Patent No.: US 10,131,462 B2
(45) Date of Patent: Nov. 20, 2018

(54) SHELF-READY PACKAGE

(71) Applicant: The Aagard Group, LLC, Alexandria, MN (US)

(72) Inventors: Jonas Capistrant, Alexandria, MN (US); Jason Norlien, Alexandria, MN (US); Amelinda Hendrickx, Doran, MN (US)

(73) Assignee: The Aagard Group, LLC, Alexandria, MN (US)

( * ) Notice: Subject to any disclaimer, the term of this patent is extended or adjusted under 35 U.S.C. 154(b) by 42 days.

(21) Appl. No.: 15/622,328

(22) Filed: Jun. 14, 2017

(65) Prior Publication Data

US 2017/0361974 A1 Dec. 21, 2017

Related U.S. Application Data

(60) Provisional application No. 62/350,790, filed on Jun. 16, 2016.

(51) Int. Cl.
*B65D 5/54* (2006.01)
*B65D 5/02* (2006.01)

(52) U.S. Cl.
CPC ..... *B65D 5/5445* (2013.01); *B65D 5/0227* (2013.01); *B65D 5/542* (2013.01)

(58) Field of Classification Search
CPC ..... B65D 5/5445; B65D 5/542; B65D 5/54; B65D 5/52; B65D 5/0227
USPC ..... 229/235
See application file for complete search history.

(56) References Cited

U.S. PATENT DOCUMENTS 4,113,100 A * 9/1978 Soja ..... B65D 5/5445 229/112
5,582,345 A * 12/1996 Lankhuijzen ..... B65D 5/5445 229/235
5,690,213 A * 11/1997 Matsumura ..... B65D 5/5206 206/45.21
5,842,576 A * 12/1998 Snow ..... B65D 5/5445 206/736
6,073,833 A 6/2000 Desrosiers et al.
7,066,321 B2 * 6/2006 Kawaguchi ..... B65D 5/0227 206/499
8,789,703 B2 7/2014 Couture et al.
8,910,856 B2 * 12/2014 Sumpmann ..... B65B 69/0033 206/746
9,187,207 B2 11/2015 Gessler, Jr. et al.
9,809,349 B2 * 11/2017 Gessler, Jr. ..... B65D 5/4608
(Continued)

*Primary Examiner* — Corey Skurdal
(74) *Attorney, Agent, or Firm* — Dicke, Billig & Czaja, PLLC

(57) ABSTRACT

Some embodiments include a package assembly comprising a case formed of a single sheet of packaging material. The single sheet includes three rows of panels. The three rows include first and second edge rows and a middle row disposed between the first and second edge rows. The panels are foldable at fold lines to form the case. A first side of the case includes a first end panel of the middle row extending fully between a top and a bottom and a front and rear of the case and an opposing end panel of the middle row extends over the first end panel. A second side of the case opposite the first side and a front and rear of the case include tear lines configured to separate the case into a cover portion and a tray portion. The first end panel is included with the cover portion.

18 Claims, 14 Drawing Sheets

(56) References Cited

U.S. PATENT DOCUMENTS

| | | | | |
|---|---|---|---|---|
| 2002/0175106 | A1* | 11/2002 | Nemoto | B65D 5/5021<br>206/526 |
| 2006/0261140 | A1* | 11/2006 | Holley, Jr. | B65D 71/36<br>229/242 |
| 2011/0049226 | A1* | 3/2011 | Moreau | B65D 5/5445<br>229/112 |
| 2011/0284621 | A1* | 11/2011 | Couture | B65D 5/5445<br>229/103 |

* cited by examiner

SHELF-READY PACKAGE

RELATED APPLICATION

This application claims the benefit of U.S. Provisional Application No. 62/350,790, filed on Jun. 16, 2016, hereby incorporated herein in its entirety by reference.

BACKGROUND

The present disclosure relates to the technical field of packaging. More particularly, it is in the field of shelf-ready secondary packaging that is both suitable for shipping and displaying product to consumers at a retail establishment.

The concept of shelf-ready packaging (SRP) is a global and industry-wide initiative proliferating the packaging industry. The purpose of SRP is to collate and protect product. For instance, SRP can provide product protection during shipment. At the retail store, the SRP can be converted from a shipping configuration into a display configuration by removing a cover portion from a tray portion of the package. An integral product tray of the SRP can simplify the shelf replenishment process at the retail location. The tray supports the retail product being displayed and graphics on the respective tray face can enhance the merchandizing at the retail location.

Some SRP constructions are known (e.g. U.S. Pat. No. 6,073,833 and U.S. Pat. No. 8,789,703) that include features that are generated from a single blank of material to produce shelf-ready packaging. Some consist of cartons formed from single blanks, while others leverage pre-glued formats. Some SRPs are also designed for automatic forming and/or assembly.

A SRP can protect the contained product from damage as it moves through the supply chain. The SRP is desirably easy to open at the point of sale without tools to remove the cover portion from the bottom tray portion. Parting lines for lids, flaps, and cover portions that are removed are desirably clean to maintain an attractive shelf presence. The tray portion of the SRP should be strong enough to support contained product as it is lifted and moved without buckling or inadvertent product release from the tray portion during shelf placement. The tray portion desirably serves to display the included retail product details while at the same time allowing for easy removal and replacement.

SUMMARY

Some aspects of the present disclosure include a package assembly comprising a case formed of a single sheet of packaging material. The single sheet includes three rows of panels. The three rows include first and second edge rows and a middle row disposed between the first and second edge rows. The panels are foldable at fold lines to form the case. A first side of the case includes a first end panel of the middle row extending fully between a top and a bottom and a front and rear of the case and an opposing end panel of the middle row extends over the first end panel. A second side of the case opposite the first side and a front and rear of the case include tear lines configured to separate the case into a cover portion and a tray portion. The first end panel is included with the cover portion.

Other aspects of the present disclosure include a package assembly including a case formed of a single sheet of packaging material having three rows of foldable panels. The case includes a cover portion, a display portion, and a separation line formed along three sides of the case between the cover portion and the display portion. The case has a shipping configuration and a display configuration. In the shipping configuration, the cover portion and the display portion are joined at the separation line on the three sides and a side foldable section of the cover portion is extended within the display portion on a fourth side to form an enclosed interior space configured for containing product. In the display configuration, the cover portion and the display portion are separated along the separation line, the cover portion including the side foldable section, and the display portion configured to removably contain the product.

DETAILED DESCRIPTION

The present disclosure relates to a package assembly, more particularly, a shelf-ready package (SRP). In accordance with aspects of the present disclosure, the package assembly can contain and protect product in a shipping configuration and can be converted to a display configuration for displaying product, such as at the retail location.

Figure 1A:
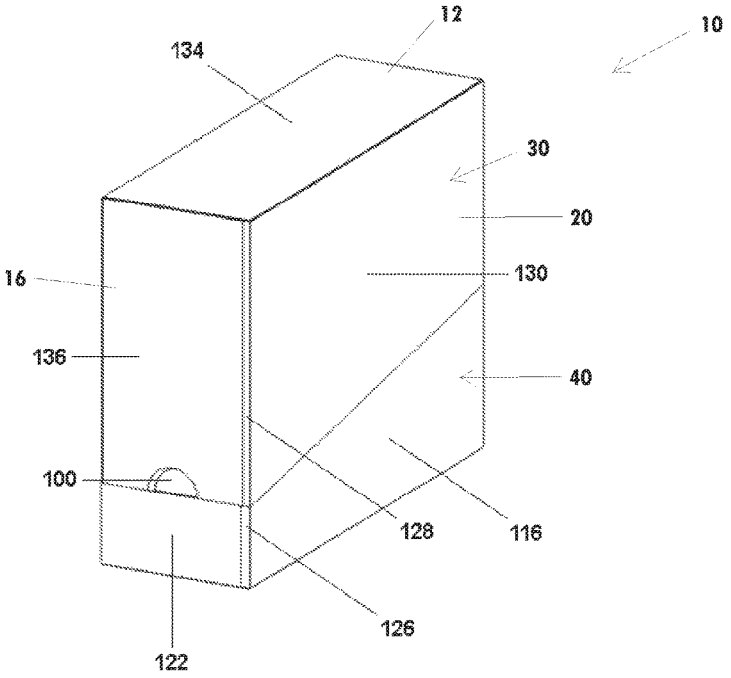
FIGS. 1A and 1B illustrate perspective views of a shelf-ready package in an assembled state in accordance with aspects of the present disclosure.
Figure 1B:
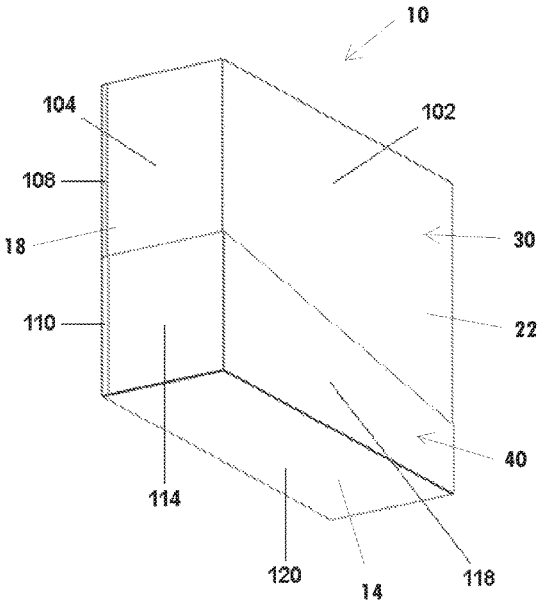

FIGS. 1A and 1B illustrate perspective views of a package assembly 10 in an assembled state in accordance with aspects of the present disclosure. FIG. 1A is a front perspective view and FIG. 1B is a rear perspective view of package assembly 10. In the assembled state, package assembly 10 is a case that is generally rectangular and includes a top 12, a bottom 14, a front 16, a rear 18, and two opposing sides 20, 22. In the assembled state, package assembly 10 is in a configuration suitable for shipping, for example. Package assembly 10 can contain a plurality of product containers (not shown) for protection and ease of handling as the product containers move through a supply chain. Package assembly 10 includes a cover portion 30 and a display portion 40. Cover portion 30 and display portion 40 are separable to convert package assembly 10 from the shipping configuration to a display configuration, as described further below.

Figure 2:
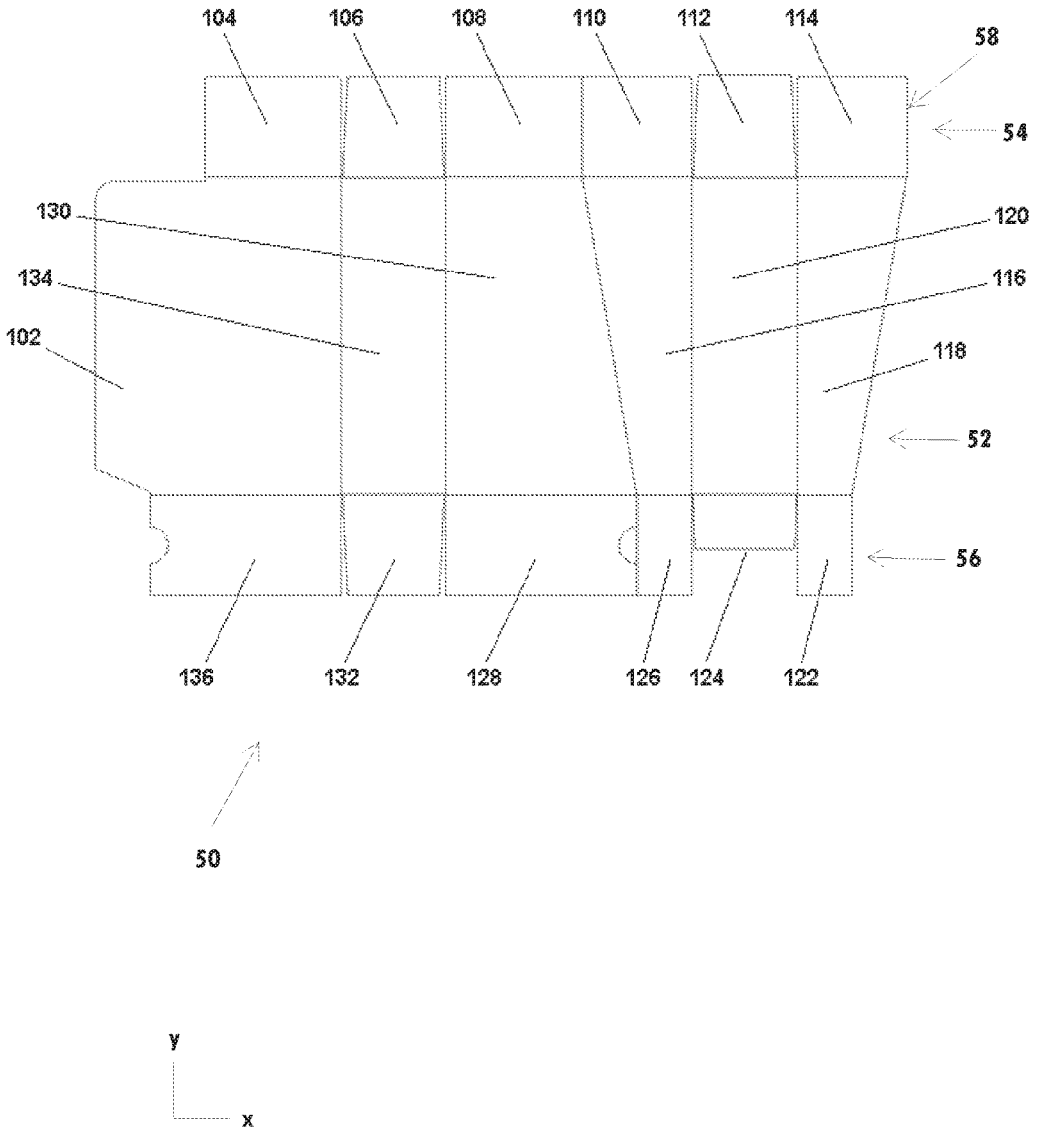
FIG. 2 illustrates a top view of the shelf-ready package of FIGS. 1A and 1B in an unassembled state in accordance with aspects of the present disclosure.

FIG. 2 illustrates a top view of package assembly 10 in an unassembled state, such as prior to being formed into the assembled state illustrated in FIGS. 1A and 1B. Package assembly 10 can be formed of a single sheet 50, or blank, of packaging material. Materials such as paperboard, chip board, micro-flute, corrugated cardboard, clay-coated board, kraft paperboard, and polymer-based structures may, as well as other suitable materials, can be employed to form the blank. Blank 50 can be any packaging material suitable to accommodate the size, shape and weight of the product containers to be contained within package assembly 10. Blank 50 includes a plurality of sections, or panels, that, when foldably assembled, form package assembly 10. Blank 50 can be formed of three rows of panels including a middle row 52 and opposing first and second side rows 54, 56 on either side of middle row 52. In one example, first and second side row 54, 56 each include six panels (e.g., 104-114 and 122-128, 132, 136, respectively) and middle row 52 includes six panels (e.g., 102, 116, 118, 120, 130, 134). First and second side rows 54, 56 each include six quadrilateral sections. In one embodiment, second side row 56 can include panels of differing sizes than that of first side row 54. In one embodiment, middle row 52 extends along the x-axis a greater distance (i.e., is longer than) than either of the opposing side rows, in particular, panel 102 extends further than panels 104 and 136 along the x-axis. In one embodiment, middle row 52 includes five quadrilateral panels and one panel (panel 102) formed as an irregular pentagon. Alternatively, panel 102 can be formed as a quadrilateral panel. In one embodiment, panel 102 can have a quadrilateral of material removed from each of the external perimeter corners, effectively increasing the number of edges on polygonal panel 102 from n to n+2 to form a relief so as not to skew package assembly 10 when bundled with other package assemblies.

With reference to FIGS. 1A-1B and FIG. 2, panels, 116 and 118 can be assembled to form the respective sides of display tray portion 40. In one embodiment, panels 116 and 118 are the same size and shape. Panels 102 and 130 extend from panels 118 and 116, respectively, to form the respective sides of cover portion 30. In one embodiment, panel 102 can include rounded and angled corners along perimeter 58 to provide for clearance during separation of cover portion 30 from tray portion 40, as further discussed below. Panel 130 at side 20 of cover portion 30 is coupled with panel 116 of tray portion 40, connected at a perforation line that is provides a tear line as cover portion 30 is separated from tray portion 40, as discussed further below. Panels 114 and 110 form the rear wall of tray portion 40, with panel 114 disposed on the exterior and panel 110 disposed on the interior side. Panels 136 and 128 can be assembled to form the front wall of cover portion 30 with panel 136 disposed on the exterior and panel 128 disposed on the interior. Panels 122 and 126 form the front of tray portion 40 with panel 122 disposed on the exterior and panel 126 disposed on the interior. Panels 114, 122 are disposed on the exterior of tray portion 40 are then made slightly wider to the outside perimeter 58 of blank 50 to improve the cosmetic appearance of tray portion by concealing the perforation lines 212, 258 and presenting a clean die cut edge on front 16 and rear 18 of tray portion 40.

Figure 3:
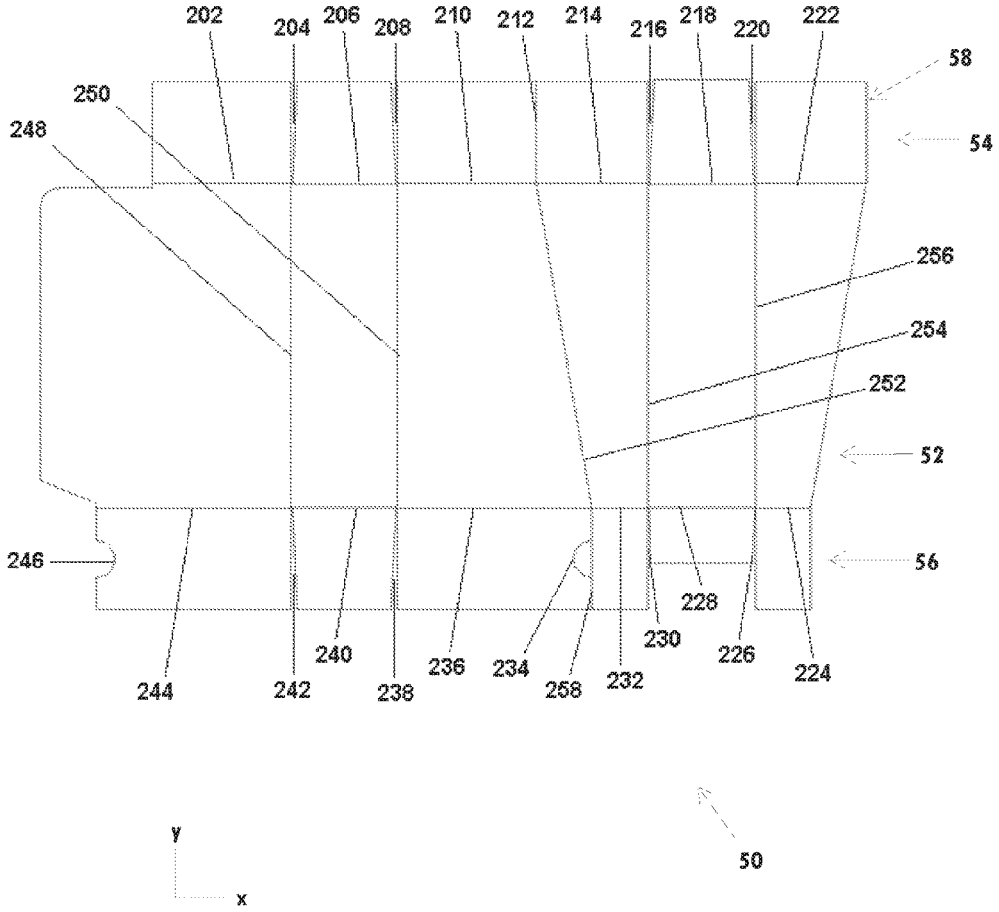
FIG. 3 illustrates another view of the shelf-ready package of FIG. 2 in accordance with aspects of the present disclosure.

FIG. 3 illustrates another view of unassembled state of package assembly 10 including blank 50. In one embodiment, blank 50 includes lines 202-256 that define, or delineate, 102-136 illustrated in FIG. 2 within an outer perimeter 58. In one embodiment, blank 50 is formed from a larger, stock sized piece of packaging material with outside profile, or perimeter, 58 of blank 50 die cut or otherwise formed. Outer perimeter 58 and lines 202-256 can be die cut, scored, creased, perforated, or laser cut, for example, as appropriate to form blank 50 and package assembly 10. Outer perimeter 58 can have be substantially linear across most or all of end panel edges of first and second side row 54, 56 (along the x-axis) and can extend non-linearly at opposing end panel edges (i.e., 104, 120, 136 and 114, 118, 122, respectively).

In one embodiment, lines 212, 252, and 258 are perforated lines that form a separation line, or tear line. A "tear line", as used herein, is a mechanism for the separation of portions of package assembly 10. In one embodiment, lines 212, 252, and 258 provide separation of panels 108 and 110, panels 130 and 116, and panels 128 and 126, respectively. In one embodiment, lines 212 and 258 extend along the y-axis at opposing ends of line 252 that extends at an angle between lines 212 and 258. Lines 212, 252, and 258 can extend end-to-end across blank 50 to form a continuous tear line between opposing edges of perimeter 58 to effectively provide for separation of portion 30 from portion 40.

With continued reference to FIGS. 2 and 3, lines 202, 206, 210, 214, 218 and 222 can be crease or foldable lines that extend between, and define, edges of side row 54 panels and middle row 52 panels. Similarly, lines 224, 228, 232, 236, 240, and 244 can be crease or foldable lines that extend between, and define, edges of side row 56 panels and middle row 52 panels. Lines 202, 206, 210, 214, 218 can be aligned to extend co-linearly along the x-axis. Lines 222, 224, 228, 232, 236, 240, and 244 can be also aligned to extend co-linearly along the x-axis. Lines 204, 208, 216, 220 can provide for separation of the panels of side row 54 and can be linear or slightly V-shaped between the panels. For example, lines 204 and 208 can be slightly V-shaped to form the edges of panel 106 that are slightly tapered together toward an outer edges of panel 106. Similarly, lines 216 and 220 are V-shaped and form side edges of panel 112. Lines 226, 230, 238, 240 can provide for separation between the panels of side row 56 and can be linear or slightly V-shaped between the panels. For example, lines 242 and 238 can be slightly V-shaped to form tapered side edges of panel 132 disposed opposite of middle panel 134 from panel 106. Lines 230 and 226 can be V-shaped to form tapered side edges of panel 124 disposed opposite of middle panel 120 from panel 112. In one embodiment, lines 248 and 250 can be foldably extend along the y-axis on opposing sides of panel 134 of middle row 52. Similarly lines 254 and 256 foldably extend along the y-axis on opposing sides of panel 120.

Figure 4:
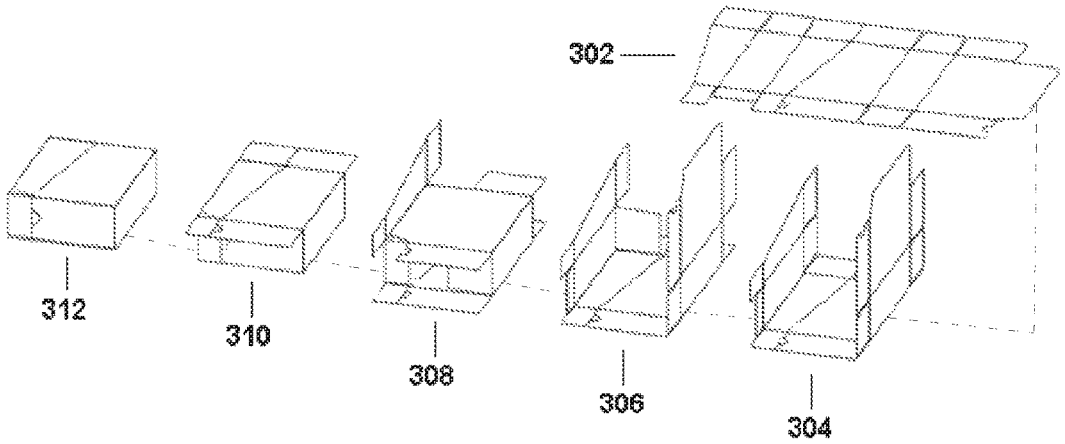
FIG. 4 illustrates states of assembly of a shelf-ready package in accordance with aspects of the present disclosure.
Figure 5:
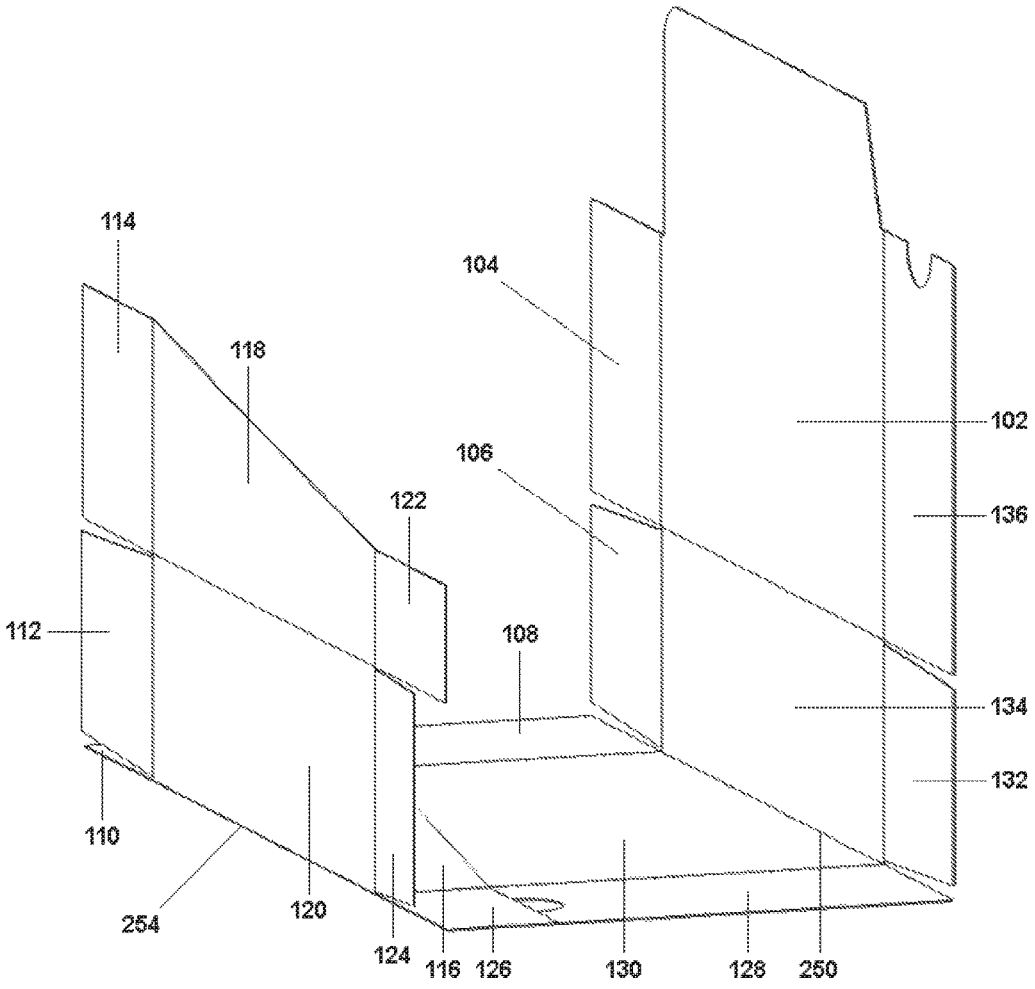
FIG. 5 illustrates an enlarged perspective view of a first state of assembly of the shelf-ready package illustrated in FIG. 4.
Figure 6A:
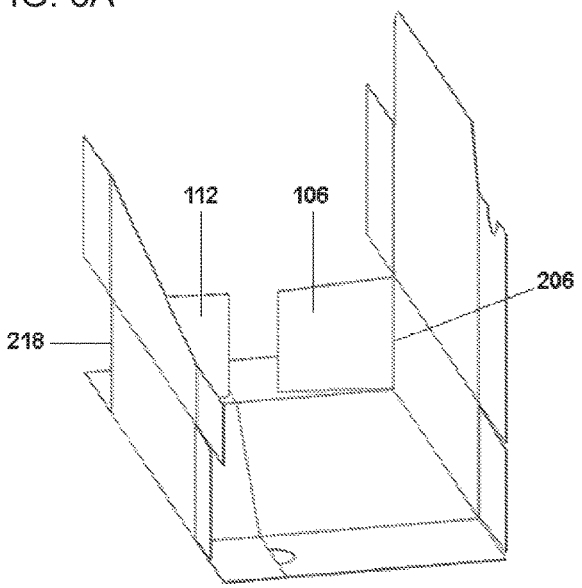
FIGS. 6A and 6B illustrate enlarged perspective views of a second state of assembly of the shelf-ready package illustrated in FIG. 4.
Figure 6B:
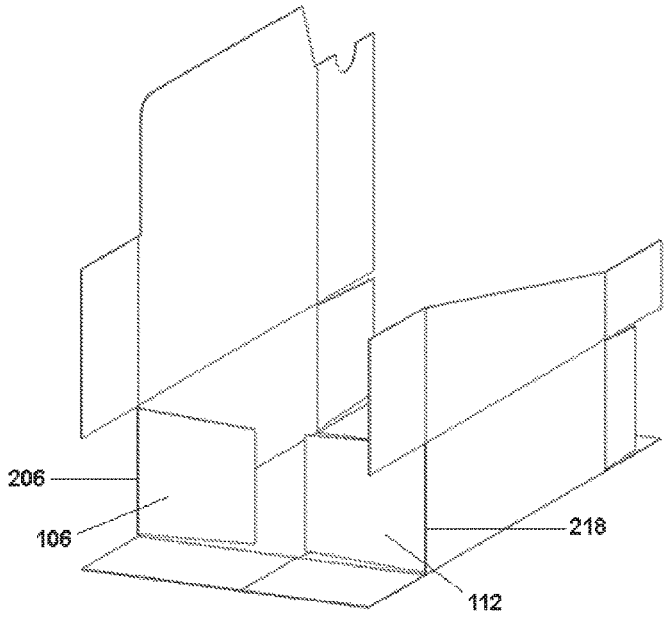
Figure 7A:
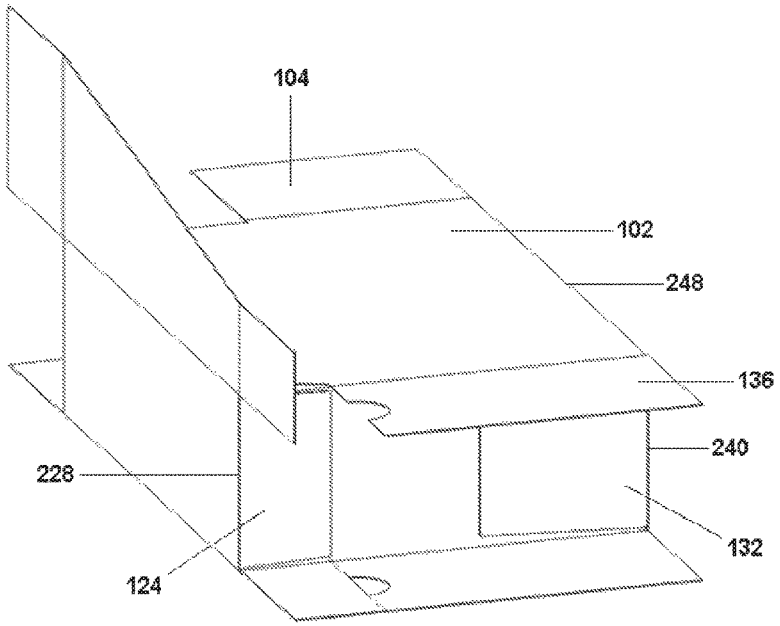
FIGS. 7A and 7B illustrate enlarged perspective views of a third state of assembly of the shelf-ready package illustrated in FIG. 4.
Figure 7B:
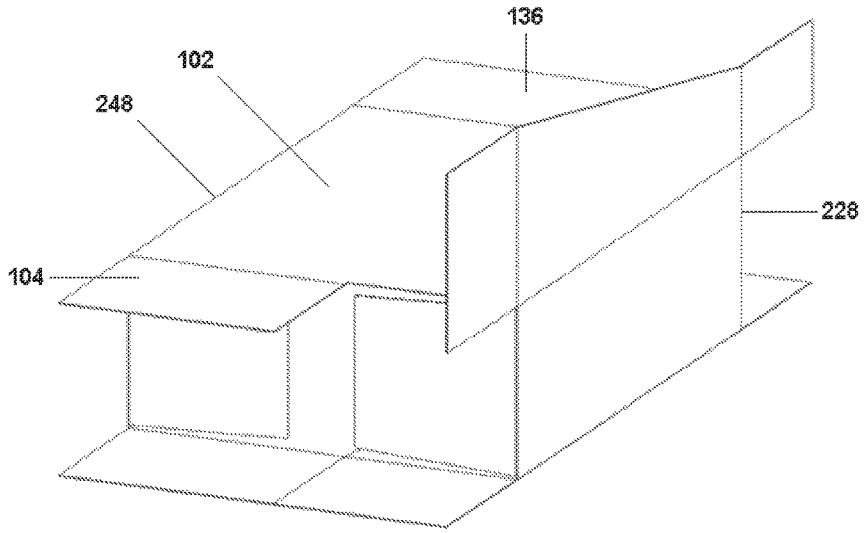
Figure 8A:
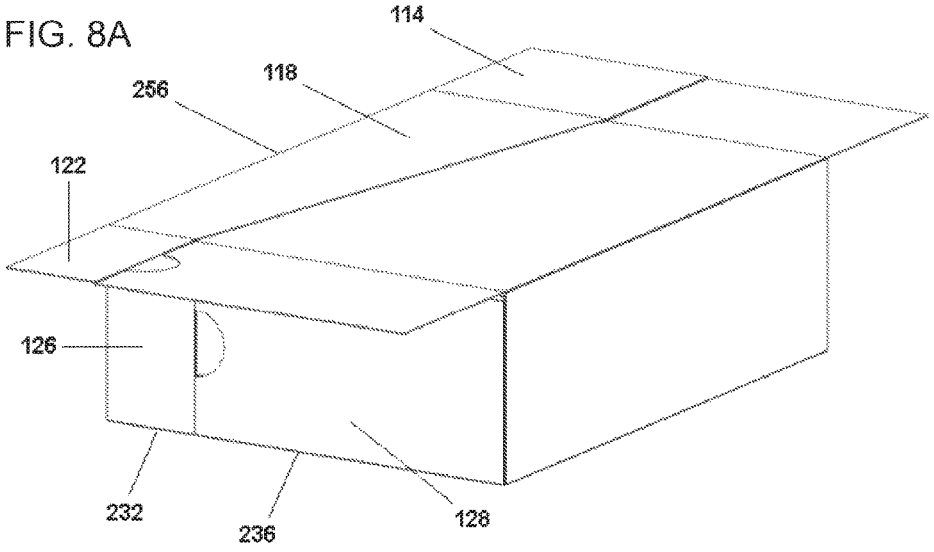
FIGS. 8A and 8B illustrate enlarged perspective views of a fourth state of assembly of the shelf-ready package illustrated in FIG. 4.
Figure 8B:
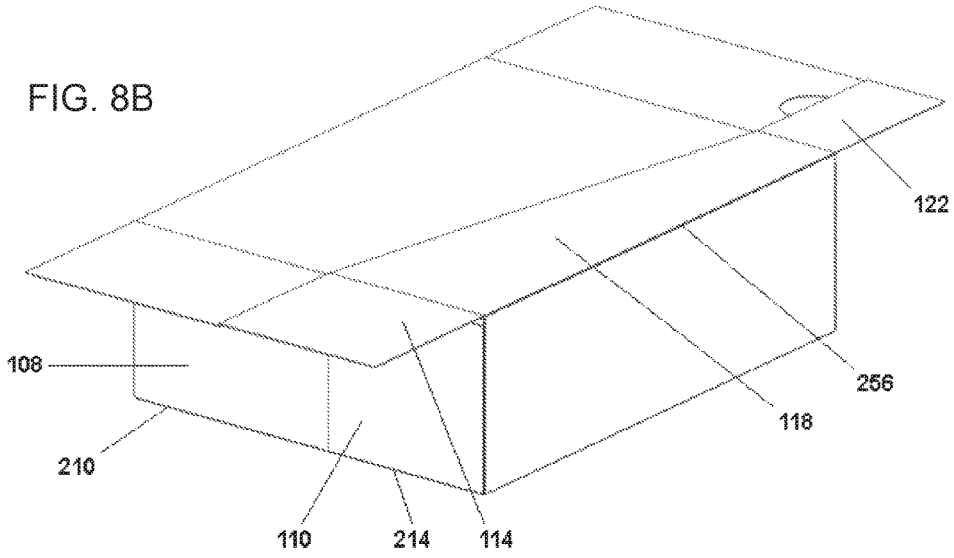
Figure 9A:
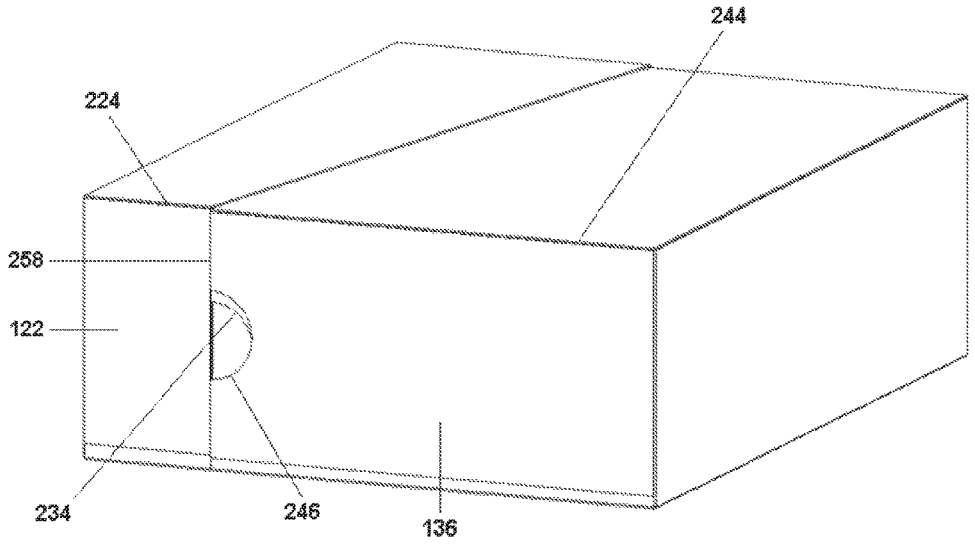
FIGS. 9A and 9B illustrate enlarged perspective views of the assembled state shelf-ready package illustrated in FIG. 4.
Figure 9B:
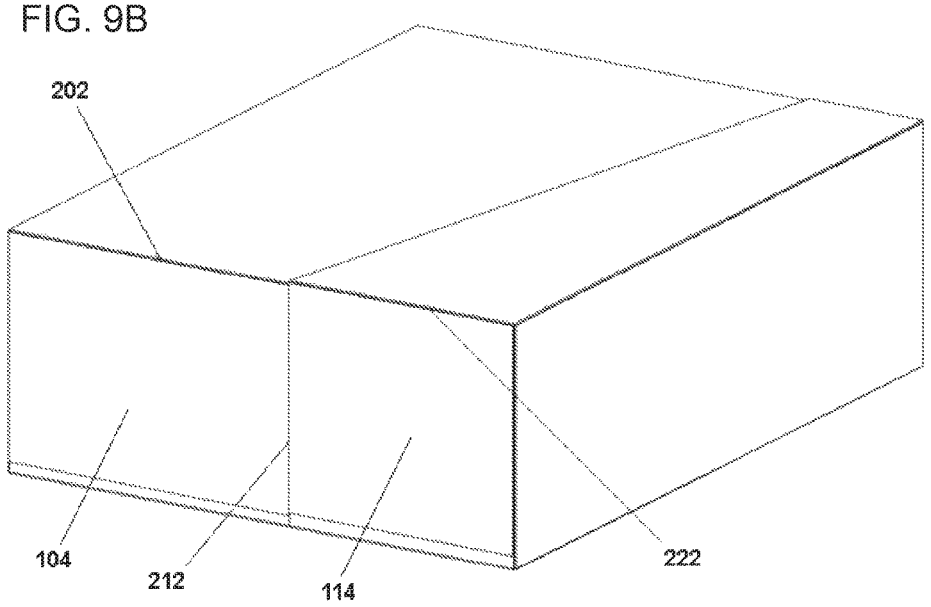

FIG. 4 illustrates example states of the assembly process of package 10 from blank 50 according to one embodiment. The assembly process begins at 302 with blank 50 as a single planar sheet of packaging material (see also, FIGS. 2 and 3) and is complete at 312 upon formation of package assembly 10 (see also, FIGS. 1A and 1B). At 302, a blank of packaging material is supplied that is generally flat, or planar. With additional reference to FIG. 5, at 304, two parallel folds are made at foldable lines 250 and 254 to form right angles between adjacent panels disposed on opposing sides of lines 250 and 254. With additional reference to FIGS. 6A and 6B, at 306, end panels 106 and 112 are folded perpendicular to the fold of 304, at foldable lines 206 and 218, respectively. With additional reference to FIGS. 7A and 7B, at 308, folds are made at line 248 to extend panel 102 parallel to panels 116, 130 and at lines 228 and 240 to extend panels 124 and 132 coplanar to each other and perpendicular to panels 120 and 134. In one embodiment, panel 102 extends fully between 134 and 120 and can contact panel 120 along the inside bottom of tray portion 40. With additional reference to FIGS. 8A and 8B, at 310, panel 118 is folded at line 256 to extend along an exterior surface of panel 102 and align panel 122 with panel 136 and panel 114 with panel 104. At 310, panels 126 and 128 are folded to extend along an exterior surface of panels 124 and 132. With additional reference to FIGS. 9A and 9B, at 312, panels 112 and 136 are folded at lines 224 and 244, respectively to form the exterior of front 16 and panels 114 and 104 are folded at lines 222 and 202, respectively, to form the exterior of rear 18 of package assembly 10. As illustrated in FIG. 9A, openings formed by lines 234 and 246 at front 16 (see also, FIG. 1) are generally aligned at 312. Merchandizing or other graphics can be included on panel 122 as well as other panels, as desired.

In one embodiment, assembly of package assembly 10 from a single flat blank 50 can utilize packaging automation, more specifically for secondary packaging, while simplifying production of package assembly 10. In accordance with aspects of the present disclosure, pre-gluing of blank 50 with a side seam gluer or similar equipment is not necessary prior to processing and assembly in an automatic packaging machine. Package assembly 10 can be formed in packaging machines without product in the case, assisting in maintenance and troubleshooting during the assembly process of the machine in which the SRP will be utilized. In one embodiment, panel 102 extends from top 12 to bottom 14 of package assembly, provide sufficient structural strength to allow for forming package assembly 10 empty, without product. Blank 50 can include right and left side edge panels, including but not limited to, panels 114, 110, 108, 104, 136, 128, 126, and 122 that, when formed, span the entire width of package assembly 10 as full overlap flaps to increase case strength when shipped laying horizontally.

Figure 10:
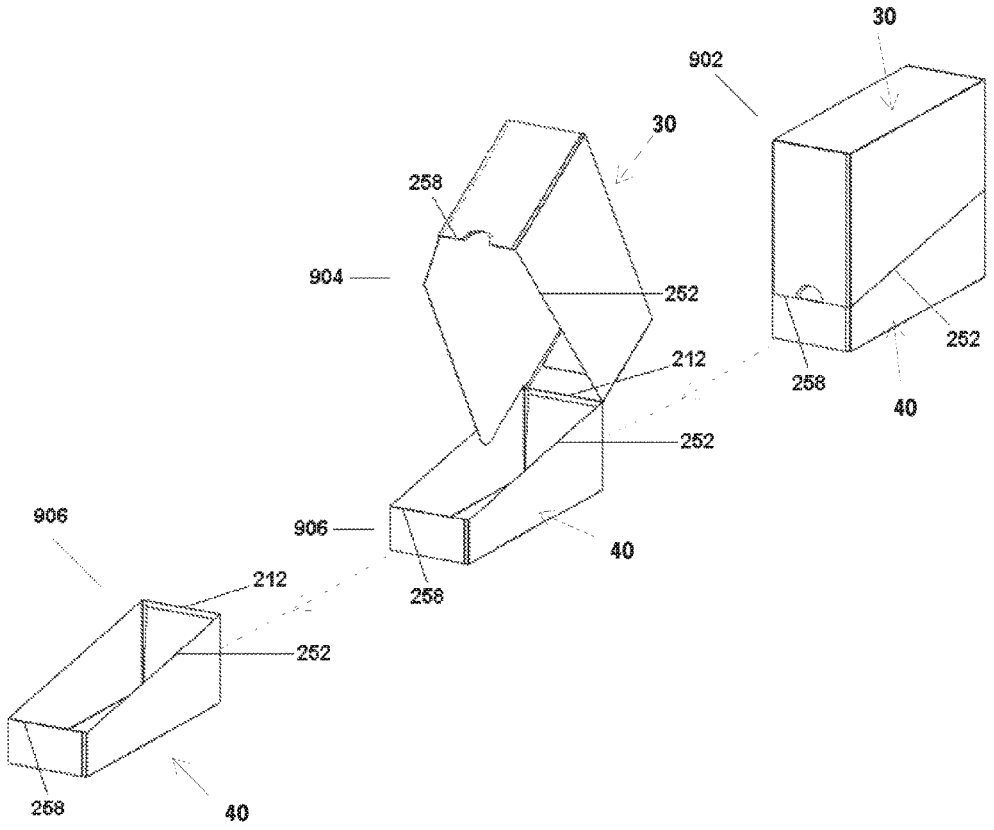
FIG. 10 illustrates perspective views a shelf-ready package in transition from a shipping configuration to a display configuration in accordance with aspects of the present disclosure.
Figure 11:
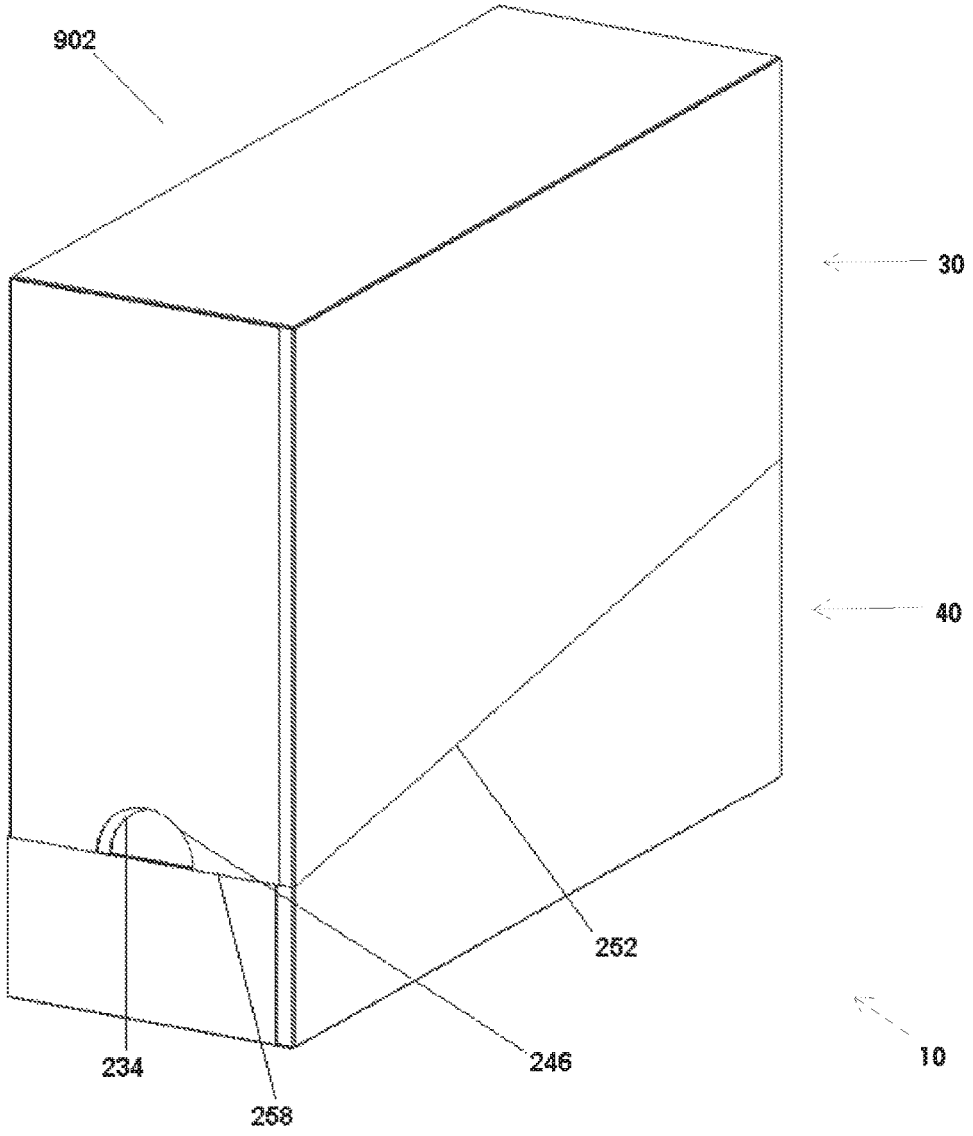
FIG. 11 illustrates an enlarged perspective view of the shelf-ready package in the assembled shipping configuration illustrated in FIG. 10.
Figure 12:
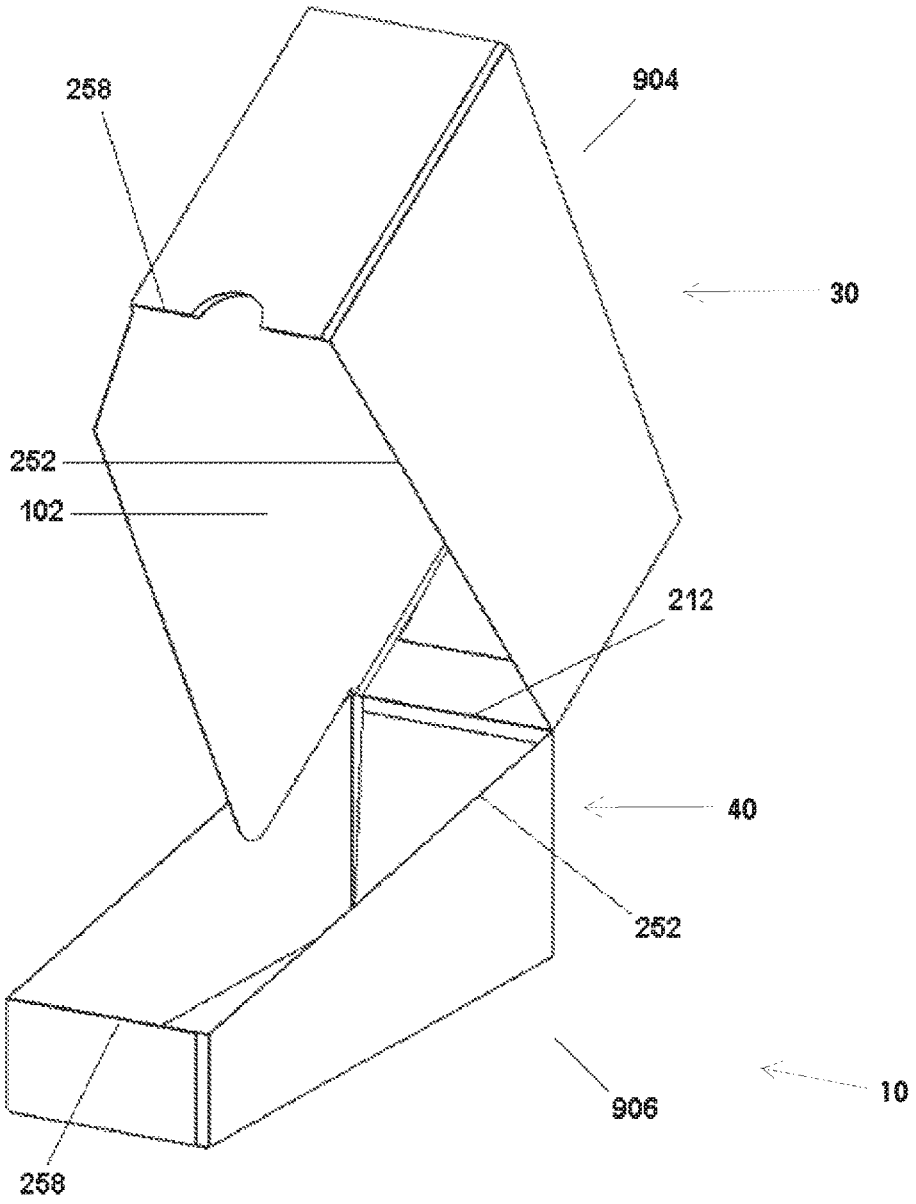
FIG. 12 illustrates an enlarged perspective view of the shelf-ready package in the partially disengaged configuration illustrated in FIG. 10.

FIG. 10 illustrates perspective views a package assembly 10 in transitioning configurations from shipping configuration to display configuration in accordance with aspects of the present disclosure. With additional reference to FIG. 11, at 902, package 10 is fully assembled with tray portion 40 coupled to removable cover portion 30 at lines 258 and 252. As a point of reference, package assembly 10 of FIG. 1 is identified at 902 in FIGS. 10 and 11. For purposes of the description of this embodiment, front 16 of package assembly 10 includes finger hole, or opening 100, formed at panels 136 and 128 of removable cover portion 30. With additional reference to FIG. 12, at 904, a user can extend a finger within, or otherwise grasp, opening 100 to leverage cover portion 30 away from tray portion 40 along tear lines 258 and 252. Additional openings 100, or finger holes, tabs, etc., can be included in package assembly 10 to aid in the separation of cover portion 30 and display portion 40 in accordance with aspects of the present disclosure. In one embodiment, extended panel 102 of cover portion 30 is not connected by perforation to side panel 118 of tray portion 40 and extended side panel 102 of cover portion 30 is extended down to bottom fold line 256 of tray portion 40 (e.g., parallel to the inside of the side wall of tray portion 40). From the included product perspective, the extended side panel of the cover portion is a complete uninterrupted interior panel surface. Extended panel 102 can reduce the opening and separation force necessary to separate cover portion 30 and tray portion 40 and can provide an aesthetically desirable display for retail tray portion 40. In some embodiments, only tear lines 212, 252, 258 must be separated (e.g., torn) to result in separation of cover portion 30 and tray portion 40. In addition, extended side panel 102 of cover portion 30 can provide rigidity to package assembly 10 when stacked in vertical orientation.

Figure 13:
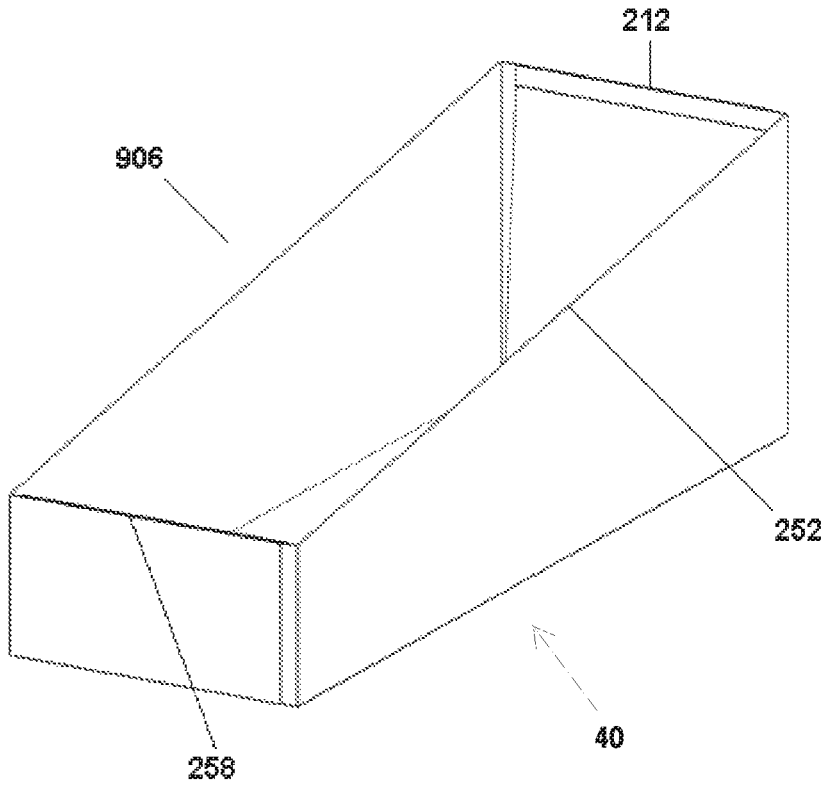
FIG. 13 illustrates an enlarged perspective view of a tray portion of the shelf-ready package illustrated in FIG. 10.
Figure 14:
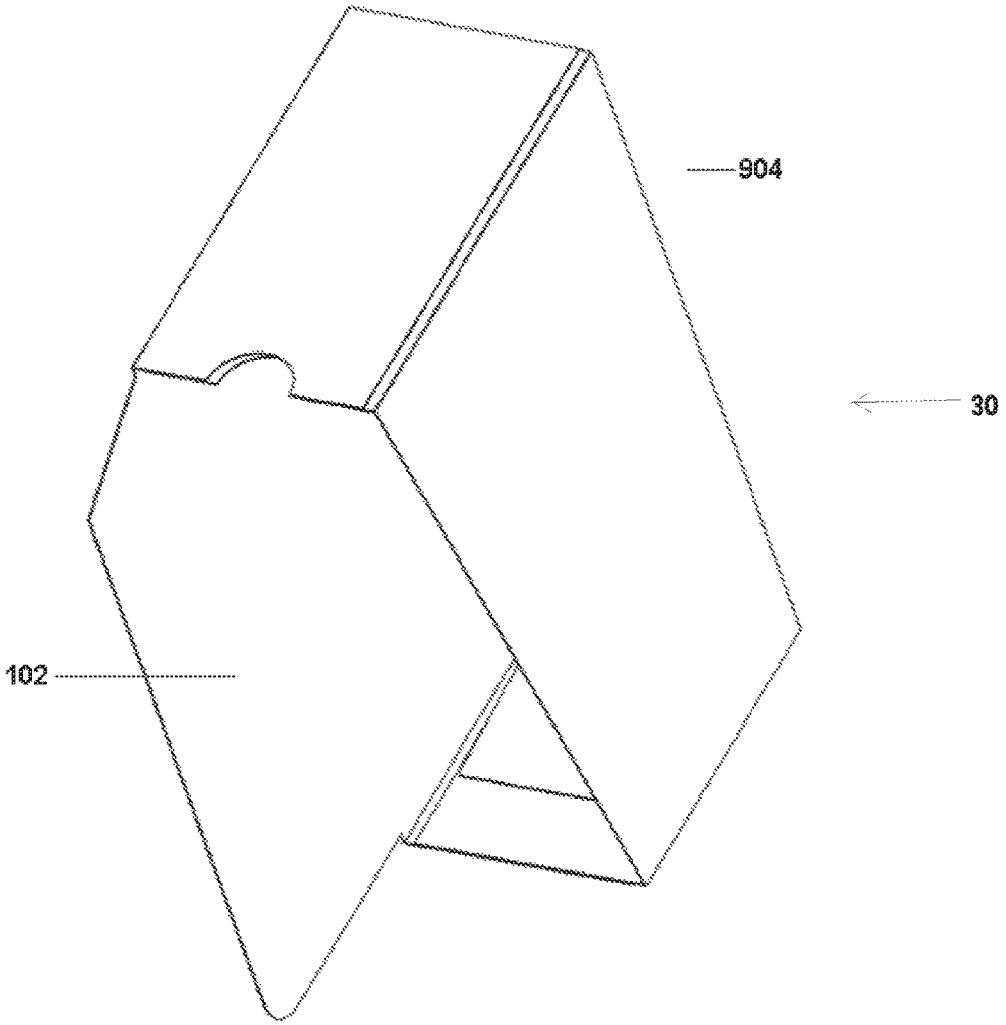
FIG. 14 illustrates an enlarged perspective view of a top portion of the shelf-ready package in accordance with aspects of the present disclosure.

With continued reference to FIG. 10 and additional reference to FIG. 13, tray portion 40 is fully separated from cover portion 30 illustrated in FIG. 14. Panel 102 forms the left side of cover portion 30. With additional reference to FIG. 1, top 12 of removable cover portion 30 that separates from tray portion 40 is formed by panel 134. Panel 120 forms bottom 14 of shelf-ready tray portion 40.

When formed into a package, extended panel 102 of cover portion that provides structural support in vertical stacking of package assemblies 10 with the formed package includes only one perforation line 252 on the opposite side 20 for top cover portion 30 and bottom tray portion 40 separation. Panel 102, as a full-height panel extending between top 12 and bottom 14, can provide side sealing and strengthen package assembly 10 when in complete assembled form, as illustrated in FIGS. 1A and 1B, and permit vertical stacking without structural failure, distortion, or collapse of package assembly 10. The contained products are provided protection by including a full height side panel 102 and the combined panels 130 and 116 on opposite side 20. The extended side panel 102 of cover portion 30 can provide ease of grasping by a user to employ leverage, assisting in ease of breakdown (e.g., collapse) of cover portion 30 for flattening and subsequent discarding once no longer needed.

Although the present invention has been illustrated and described herein with reference to the preferred embodiment and specific examples, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A package assembly, comprising:

a case formed of a single sheet of packaging material, the single sheet including three rows of panels, the three rows comprising first and second edge rows and a middle row disposed between the first and second edge rows, the panels being foldable at fold lines to form the case, wherein a first side of the case includes a first end panel of the middle row extending fully between a top and a bottom and a front and rear of the case and an opposing end panel of the middle row extends over the first end panel, wherein a second side of the case opposite the first side and a front and rear of the case include tear lines configured to separate the case into a cover portion and a tray portion, wherein the first end panel is included with the cover portion.

2. The package assembly of claim 1, wherein the tear line includes an angled portion and horizontal portions, the angled portion extends parallel to an angled edge of a panel on an opposing side of the case, the horizontal portion extend from opposing ends of the angled portion and extend parallel to a bottom surface of the case.

3. The package assembly of claim 2, wherein the angled portion extends fully across a center panel of the middle row.

4. The package assembly of claim 1, wherein each foldable section is a different shape and size than the adjoining foldable panels.

5. The package assembly of claim 1, further comprising:

an aperture formed along the tear line, the aperture configured to accommodate a finger of a user.

6. The package assembly of claim 1, wherein the pentagonal foldable section forms a side of the top portion and is extendable within the bottom portion of the case.

7. The package assembly of claim 1, wherein perimeter edges of the foldable sections are formed by at least one of die cuts, perforations, creases, score lines, and laser cuts.

8. The package assembly of claim 1, wherein a perimeter edge extending across the three rows of the single sheet is non-linear.

9. The package assembly of claim 1, wherein the tear line extends fully across each of the three rows to divide the case into the cover portion and the display portion.

10. The package assembly of claim 1, wherein each of the edge rows include six quadrilateral panels.

11. A package assembly, comprising:

a case formed of a single sheet of packaging material including three rows of foldable panels, the case comprising a cover portion, a display portion, and a separation line formed along three sides of the case between the cover portion and the display portion, the case having a shipping configuration and a display configuration, wherein in the shipping configuration, the cover portion and the display portion are joined at the separation line on the three sides and a side foldable section of the cover portion is extended within the display portion on a fourth side to form an enclosed interior space configured for containing product, wherein in the display configuration, the cover portion and the display portion are separated along the separation line, the cover portion including the side foldable section, and the display portion configured to removably contain the product.

12. The package assembly of claim 11, wherein the case is rectangular including six side surfaces, wherein a single foldable panel forms an exterior surface of each of four of the six side surfaces, and another single panel forms an interior surface of one of the side surfaces.

13. The package assembly of claim 11, wherein cover portion includes the single panel forms the interior surface extending from a top side to an opposing bottom side of the case in the shipping configuration and is slidably separable from the display portion to transition the case to the display configuration.

14. The package assembly of claim 11, wherein the single sheet has non-linear top and bottom perimeter edges extending across the three rows of foldable panels.

15. The package assembly of claim 11, wherein side edge panels of the foldable panels extend to form interior surfaces extending along an entire length of the case.

16. The package assembly of claim 11, wherein a front panel of the foldable panels includes an opening extending along the separation line configured to aid separation of the cover portion from the display portion.

17. The package assembly of claim 11, wherein the single sheet includes eighteen panels, each panel having edges are formed by at least one of die cuts, perforations, creases, score lines, and laser cuts.

18. The package assembly of claim 11, wherein two of the three rows include six quadrilateral panels.

* * * * *